US009534453B2

(12) United States Patent
Machin et al.

(10) Patent No.: US 9,534,453 B2
(45) Date of Patent: Jan. 3, 2017

(54) UMBILICAL MANAGEMENT SYSTEM AND METHOD FOR SUBSEA WELL INTERVENTION

(75) Inventors: Jonathan Machin, Gallop Gables (SG); Jean-Bernard Blamengin, New Orleans, LA (US); Peter Nellessen, Missouri City, TX (US)

(73) Assignee: OneSubsea IP UK Limited, London (GB)

( * ) Notice: Subject to any disclaimer, the term of this patent is extended or adjusted under 35 U.S.C. 154(b) by 610 days.

(21) Appl. No.: 13/058,351

(22) PCT Filed: Aug. 12, 2009

(86) PCT No.: PCT/US2009/053564
§ 371 (c)(1),
(2), (4) Date: Apr. 27, 2011

(87) PCT Pub. No.: WO2010/019675
PCT Pub. Date: Feb. 18, 2010

(65) Prior Publication Data

US 2011/0198092 A1 Aug. 18, 2011

Related U.S. Application Data

(60) Provisional application No. 61/088,572, filed on Aug. 13, 2008.

(51) Int. Cl.
*E21B 7/12* (2006.01)
*E21B 17/01* (2006.01)
(Continued)

(52) U.S. Cl.
CPC ..... *E21B 17/015* (2013.01); *E21B 17/012* (2013.01); *E21B 33/0355* (2013.01); *E21B 33/076* (2013.01)

(58) Field of Classification Search
USPC ..... 166/338, 344, 346, 349, 352, 85.1; 405/190, 191, 158, 200
See application file for complete search history.

(56) References Cited

U.S. PATENT DOCUMENTS 4,682,913 A * 7/1987 Shatto et al. ..... 405/169
4,793,737 A * 12/1988 Shotbolt ..... 405/169
(Continued)

FOREIGN PATENT DOCUMENTS

WO 2006/099316 9/2006
WO 2008/118680 10/2008
(Continued)

OTHER PUBLICATIONS

International search report for the equivalent PCT patent application No. PCT/US2009/53564 issued on Mar. 16, 2010.

*Primary Examiner* — Matthew R Buck
*Assistant Examiner* — Aaron Lembo
(74) *Attorney, Agent, or Firm* — Chamberlain Hrdlicka

(57) ABSTRACT

An intervention system and method for control of seabed equipment, including a control umbilical connected to a support vessel or rig via a surface winch; a tether connected to underwater seabed equipment; and an umbilical management system unit coupled between the tether and the control umbilical to couple the support vessel or rig to the seabed equipment. The control umbilical and the tether via the umbilical management system unit provide a communications channel for communicating media, including data, electrical power, hydraulic power and/or chemical treatment fluid, from the support vessel or rig to the seabed equipment. The umbilical management system unit allows for easy deployment and management of the control umbilical and tether and can reel in or pay out the tether and/or the control umbilical under remote control or autonomously.

40 Claims, 5 Drawing Sheets

(51) Int. Cl.
*E21B 33/035* (2006.01)
*E21B 33/076* (2006.01)

(56) References Cited

U.S. PATENT DOCUMENTS

| | | | | |
|---|---|---|---|---|
| 5,007,482 | A * | 4/1991 | Forsyth et al. | 166/345 |
| 5,320,175 | A * | 6/1994 | Ritter et al. | 166/339 |
| 5,722,793 | A * | 3/1998 | Peterson | 405/164 |
| 5,778,981 | A * | 7/1998 | Head | 166/345 |
| 6,102,124 | A * | 8/2000 | Skeels et al. | 166/347 |
| 6,167,831 | B1 * | 1/2001 | Watt et al. | 114/322 |
| 6,223,675 | B1 * | 5/2001 | Watt et al. | 114/312 |
| 6,276,456 | B1 * | 8/2001 | Head | 166/359 |
| 6,350,085 | B1 * | 2/2002 | Bath et al. | 405/154.1 |
| 6,371,693 | B1 * | 4/2002 | Kopp et al. | 405/158 |
| 6,386,290 | B1 * | 5/2002 | Headworth | 166/346 |
| 6,390,012 | B1 | 5/2002 | Watt et al. | |
| 6,588,980 | B2 * | 7/2003 | Worman et al. | 405/158 |
| 6,588,985 | B1 * | 7/2003 | Bernard | 405/191 |
| 6,691,775 | B2 | 2/2004 | Headworth | |
| 6,729,802 | B2 * | 5/2004 | Giovannini et al. | 405/158 |
| 6,745,840 | B2 | 6/2004 | Headworth | |
| 6,752,100 | B2 * | 6/2004 | Guinn et al. | 114/258 |
| 6,776,559 | B1 * | 8/2004 | Peterson | 405/158 |
| 6,796,261 | B2 * | 9/2004 | Colyer | 114/258 |
| 6,834,724 | B2 | 12/2004 | Headworth | |
| 6,843,321 | B2 * | 1/2005 | Carlsen | 166/355 |
| 6,902,199 | B2 | 6/2005 | Colyer et al. | |
| 6,913,083 | B2 * | 7/2005 | Smith | 166/336 |
| 6,957,929 | B1 * | 10/2005 | Rachel et al. | 405/158 |
| 7,033,113 | B2 * | 4/2006 | March | 405/158 |
| 7,331,394 | B2 * | 2/2008 | Edwards et al. | 166/339 |
| 7,431,092 | B2 * | 10/2008 | Haheim et al. | 166/343 |
| 7,572,085 | B2 * | 8/2009 | Luppi | 405/158 |
| 7,717,646 | B2 * | 5/2010 | Webster | 405/168.3 |
| 7,770,655 | B2 * | 8/2010 | Wilde et al. | 166/381 |
| 7,798,232 | B2 * | 9/2010 | Headworth | 166/352 |
| 7,891,429 | B2 * | 2/2011 | Boyce et al. | 166/340 |
| 7,921,919 | B2 * | 4/2011 | Horton, III | 166/366 |
| 7,926,579 | B2 * | 4/2011 | Sbordone et al. | 166/384 |
| 7,985,036 | B2 * | 7/2011 | Giovannini et al. | 405/171 |
| 8,096,364 | B2 * | 1/2012 | Dursley | 166/338 |
| 2003/0106714 | A1 * | 6/2003 | Smith et al. | 175/6 |
| 2004/0134662 | A1 | 7/2004 | Chitwood et al. | |
| 2004/0218981 | A1 * | 11/2004 | Chenin | 405/169 |
| 2005/0276665 | A1 * | 12/2005 | Entralgo et al. | 405/190 |
| 2006/0231264 | A1 | 10/2006 | Boyce et al. | |
| 2006/0231265 | A1 * | 10/2006 | Martin | 166/365 |
| 2007/0258774 | A1 | 11/2007 | Thompson et al. | |
| 2008/0185152 | A1 | 8/2008 | Sbordone et al. | |
| 2008/0185153 | A1 | 8/2008 | Smedstad et al. | |
| 2008/0314597 | A1 | 12/2008 | Sbordone et al. | |
| 2009/0212969 | A1 * | 8/2009 | Voss | 340/853.1 |
| 2010/0307760 | A1 * | 12/2010 | Shouse | 166/339 |
| 2011/0203803 | A1 * | 8/2011 | Zemlak et al. | 166/349 |
| 2011/0297389 | A1 * | 12/2011 | McKay | 166/349 |
| 2012/0266803 | A1 * | 10/2012 | Zediker et al. | 114/337 |

FOREIGN PATENT DOCUMENTS

| | | |
|---|---|---|
| WO | 2008/122577 | 10/2008 |
| WO | 2009/053022 | 4/2009 |

* cited by examiner

100

200

UMBILICAL MANAGEMENT SYSTEM AND METHOD FOR SUBSEA WELL INTERVENTION

CROSS REFERENCE TO RELATED APPLICATIONS

The invention is related to and claims the benefit of priority from U.S. Provisional Patent Application Ser. No. 61/088,572 of Machin et al., entitled "CONTROL UMBILICAL AND METHOD WITH DEDICATED UMBILICAL MANAGEMENT SYSTEM FOR LIGHT WELL SUBSEA INTERVENTION SYSTEMS," filed on Aug. 13, 2008, the entire contents of the disclosures of which is hereby incorporated by reference herein.

BACKGROUND OF THE INVENTION

Field of the Invention

The present invention generally relates to methods and systems for subsea well intervention and work-over on seabed equipment, and more particularly to an Open Water Wireline (OWWL) or Spoolable Compliant Guide (SCG) well intervention system and method, including a control umbilical (CU), preferably a multipurpose control umbilical (MCU), deployed and managed using a dedicated remotely operated or autonomous umbilical management system unit (UMSU), wherein the CU or MCU is connected via the UMSU to one or more tethers that connect in turn to one or more subsea equipment.

Background

Well intervention and work-over on seabed equipment, such as subsea oil wells, can be performed using open water wireline (OWWL) or Spoolable Compliant Guide (SCG) systems. During these work-over operations, the main functions of the seabed equipment are typically, if not always, required to be remotely controlled and operated from a support ship or rig, which is in attendance. Such control includes the communication or transfer of one or more types of media, including data, electrical power, hydraulic power and a chemical treatment fluid or fluids. In order to provide such control, the media is communicated through one or more umbilicals which are launched from the support ship or rig for the purpose of connecting the support ship or rig to the seabed equipment.

However, there exist a number of problems that must be solved before such well intervention systems can become widely accepted in the industry. Existing intervention and work-over methods and systems suffer from various discovered problems, as further described herein. There are certain characteristics of the Open Water Wireline (OWWL) or Spoolable Compliant Guide (SCG) methods and systems that complicate the design of the control umbilicals and can in certain cases create problems that affect the smooth running of the subsea work-over operation. For example, due to the up and down heaving motion of the support vessel or rig caused by the ocean waves, a control umbilical is generally required to be somehow tensioned in order to prevent it from buckling or crumpling under the resulting compressive forces and displacements that can arise. The construction of a typical control umbilical is such that exposure to compressive forces and displacements is generally undesirable during operation.

Another problem of free hanging umbilicals arises when environmental conditions, such as a subsea current, and the like, cause the umbilical to deflect without control in the water column. One known area of concern of such behavior is the twisting or looping of the umbilical on itself. During recovery of the umbilical, this loop can close itself and as such permanently damage the umbilical. Another concern with the horizontal excursion is the potential contact between the umbilical system and other downlines, with the potential risk of damage to the umbilical. This problem can occur when additional lines are placed in the water column that could cause clashing or tangling of the lines. In this case, it is extremely important to actively manage one or more of such cables to keep them from clashing.

The above issues may be reduced somewhat with the use of a plurality and smaller umbilicals. For example, a smaller umbilical may be used incorporating only the electrical power and communication cables or fibers similar to those commonly used by Remotely Operated Vehicles (ROVs). U.S. Patent Application Publication No. 20060231264 assigned to SAIPEM describes an open light well intervention system that employs as a data communication and power supply umbilical the umbilical of the ROV. However, this solution is limited. One problem of the SAIPEM system is that it would require multiple umbilicals to supply the functions needed by the different subsea equipment identified, and which consist of both the intervention equipment and the ROV. Also, such an arrangement has practical limitations in that the deployment of both the intervention equipment and the ROV are dependent on each other.

One known method for keeping an umbilical under a constant tension employs a constant tension winch positioned on the vessel. Such systems have a disadvantage that, in tensioning the umbilical, they cause the umbilical to be repeatedly bent and straightened out again at a number of locations, e.g., on sheaves or in bends and that over time cause fatigue and/or internal friction damage, eventually leading to failure of internal cables or tubes contained in the umbilical.

Constant tension winch systems also have the disadvantage that they are generally expensive in terms of procurement of the specialized winch required. Also, constant tension winch techniques would be generally very difficult to implement in deepwater because the weight of the umbilical will by necessity increase to account for the increasing water depth. Thus, the lengthy heavy umbilical itself and the constant tension winch will need to become very large and hence there will be a correspondingly undesirable economic impact to the work-over activity.

In addition, existing tensioned umbilical methods generally require the vessel to be operated at or close to the vertical center of the seabed equipment it controls and, typically, require the umbilical to be connected to the seabed equipment on surface before being run with the seabed equipment, while the latter is deployed. U.S. Pat. No. 6,223,675 describes an underwater apparatus for performing subsurface operations. The apparatus includes a linelatch system that is made up of a tether management system (TMS) connected to a flying latch vehicle by a tether. The TMS controls the amount of free tether between itself and the flying latch vehicle using a reeling in and out system well known in the art. The TMS is lowered and positioned to the seafloor using an umbilical, which is then disconnected from the tether management system. The TMS is connected to the underwater subsea equipment via the flying latch vehicle.

However, none of the above systems provide a fully satisfactory umbilical solution for underwater intervention systems. Most existing systems cannot be deployed and connected to the intervention seabed package readily and are subject excessive bending and stressing of the umbilical that causes over time fatigue, damage and failure of internal cables and tubes contained in the umbilical.

SUMMARY OF THE INVENTION

Therefore, there is a need for a method and apparatus (which also may be referred to herein as a "system") that address discovered problems with existing systems and methods for subsea intervention and work-over, such as light well intervention and work-over on seabed equipment. The inventive system is particularly suitable for light well intervention using open water wireline or a spoolable compliant guide. The above and other needs and problems are addressed by the present invention, exemplary embodiments of which are presented in connection with the associated figures.

The present invention provides an improved intervention system and method including a control umbilical (CU), preferably a multipurpose control umbilical (MCU), having a dedicated and motorized umbilical management system unit (UMSU) and one or more tethers for connecting with one or more subsea equipment as needed. The CU or MCU is connected at one end to a support vessel or rig and on the other end to a tether or a plurality of tethers connected to one or more unit of seabed equipment under the ocean and/or at the ocean floor. The CU or MCU and the tether are themselves interconnected together, in a suitable operative manner, e.g., at their adjacent ends in proximity to the seabed, in order to ultimately connect the support vessel or rig to the seabed equipment. The CU or MCU and the tether include communication channels for communication of various types of media, including one or more of data, electrical power, hydraulic power and chemical treatment fluid.

The inventive system and method further comprise a dedicated UMSU which forms all connections needed between the CU or MCU and the tether or tethers. One advantageous feature of the UMSU is that it is designed to be capable of reeling in or paying out the tether, or tethers, and the CU or MCU under remote control or autonomously. The UMSU facilitates deployment of the CU or MCU separately from the deployment of the subsea equipment, preferably without a winch, and also serves as a weight to compensate for the heave motion and thus keep the CU or MCU under tension as needed. The UMSU also includes thrusters which can move the UMSU in two planes and rotate about its central axis in the water column to avoid clashing with other cables. In conjunction with lowering and raising of the UMSU in the water column by the surface winch, the UMSU can thus be used to actively position the CU and/or MCU in three planes by remote operation from controls at the surface, and the like.

Accordingly, in exemplary aspects of the present invention there is provided an intervention system and method for control of seabed equipment, including a control umbilical connected at one end thereof to a support vessel or rig in a suitable manner, e.g., via a surface winch; a tether connected at one of its ends to underwater seabed equipment; and an umbilical management system unit coupled to the other end of the tether and the other end of the control umbilical; the umbilical management system unit coupling the control umbilical via the tether to the seabed equipment, thereby coupling the support vessel or rig to the underwater seabed equipment. The control umbilical and the tether via the umbilical management system unit provide a communications channel for communicating media, including data, electrical power, hydraulic power and/or chemical treatment fluid, from the support vessel or rig to the seabed equipment. The umbilical management system unit allows for easy deployment and management of the control umbilical and tether and can reel in or pay out the tether and/or the control umbilical under remote control or autonomously.

The methods of the invention include active and/or passive methods which control the umbilical, i.e., the position of the umbilical in the water column, so that the umbilical is not subjected to excessive forces and also does not interfere with other deployed downlines, such as wireline, pumping lines, riser system, and/or ROV umbilicals under environmental conditions, i.e., conditions of the deployment of the system of the invention. This can be accomplished in several different ways. In one embodiment, the position of the umbilical is controlled by adjusting the tether length. Alternatively, the umbilical can be controlled by adjusting the horizontal excursion of the umbilical management system unit (UMSU) using built in thrusters. The umbilical can also be controlled by adjusting the vertical position of the UMSU.

Still other aspects, features, and advantages of the present invention are readily apparent from the entire description thereof, including the figures, which illustrate a number of exemplary embodiments and implementations. The present invention is also capable of other and different embodiments, and its several details can be modified in various respects, all without departing from the spirit and scope of the present invention. Accordingly, the drawings and descriptions are to be regarded as illustrative in nature, and not as restrictive.

BRIEF DESCRIPTION OF THE DRAWINGS

The embodiments of the present invention are illustrated by way of example, and not by way of limitation, in the figures of the accompanying drawings and in which like reference numerals refer to similar elements and in which.

DETAILED DESCRIPTION

Various embodiments and aspects of the invention will now be described in detail with reference to the accompanying figures. The terminology and phraseology used herein is solely used for descriptive purposes and should not be construed as limiting in scope. Language such as "including," "comprising," "having," "containing," or "involving,"

and variations thereof, is intended to be broad and encompass the subject matter listed thereafter, equivalents, and additional subject matter not recited.

Figure 1:
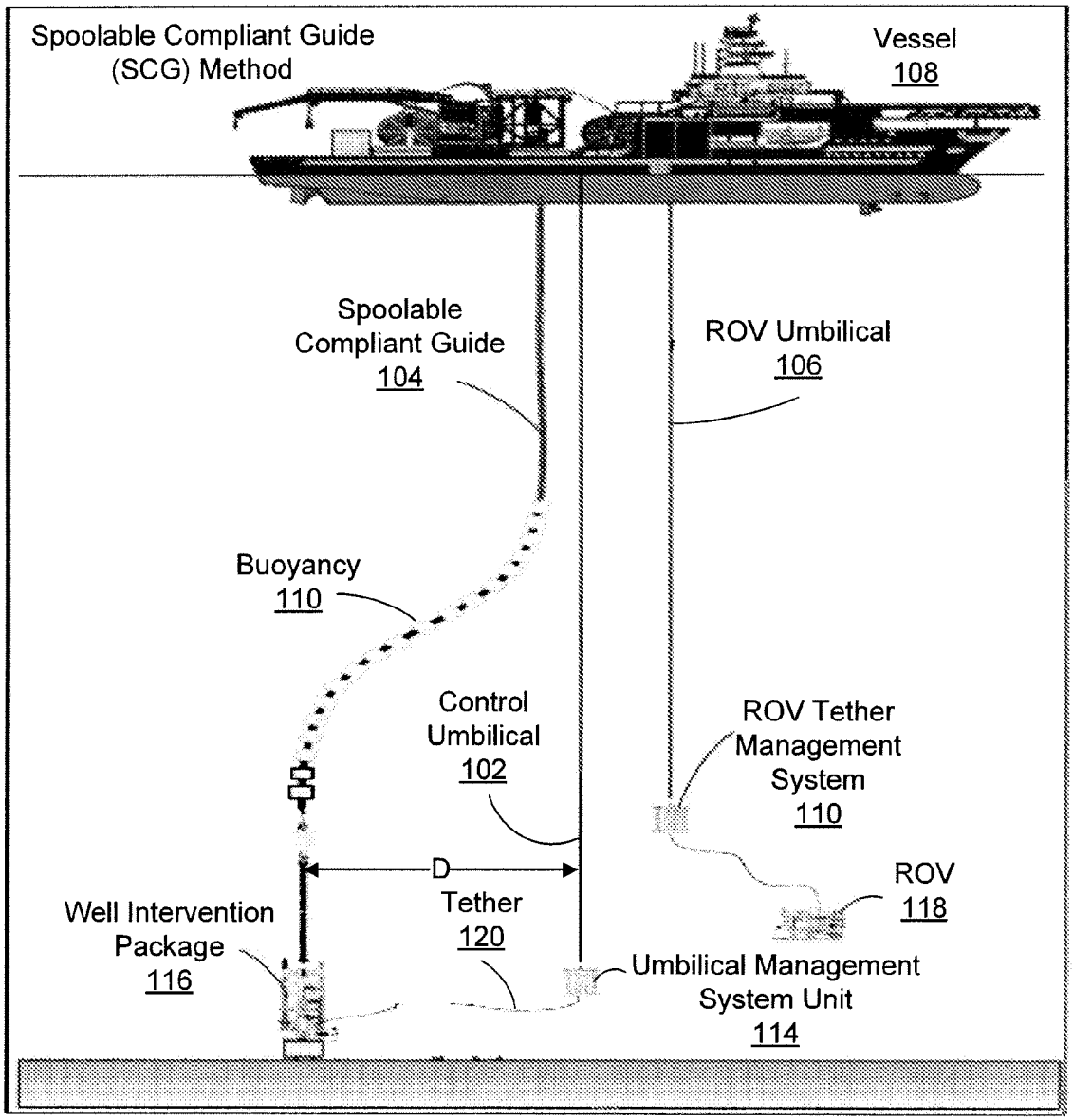
FIG. 1 illustrates an exemplary Spoolable Compliant Guide (SCG) method and system comprising a control umbilical (CU) or multipurpose control umbilical (MCU) with a dedicated umbilical management system unit (UMSU) and a tether for subsea intervention and work-over on seabed equipment, according to one embodiment of the present invention.
Figure 2:
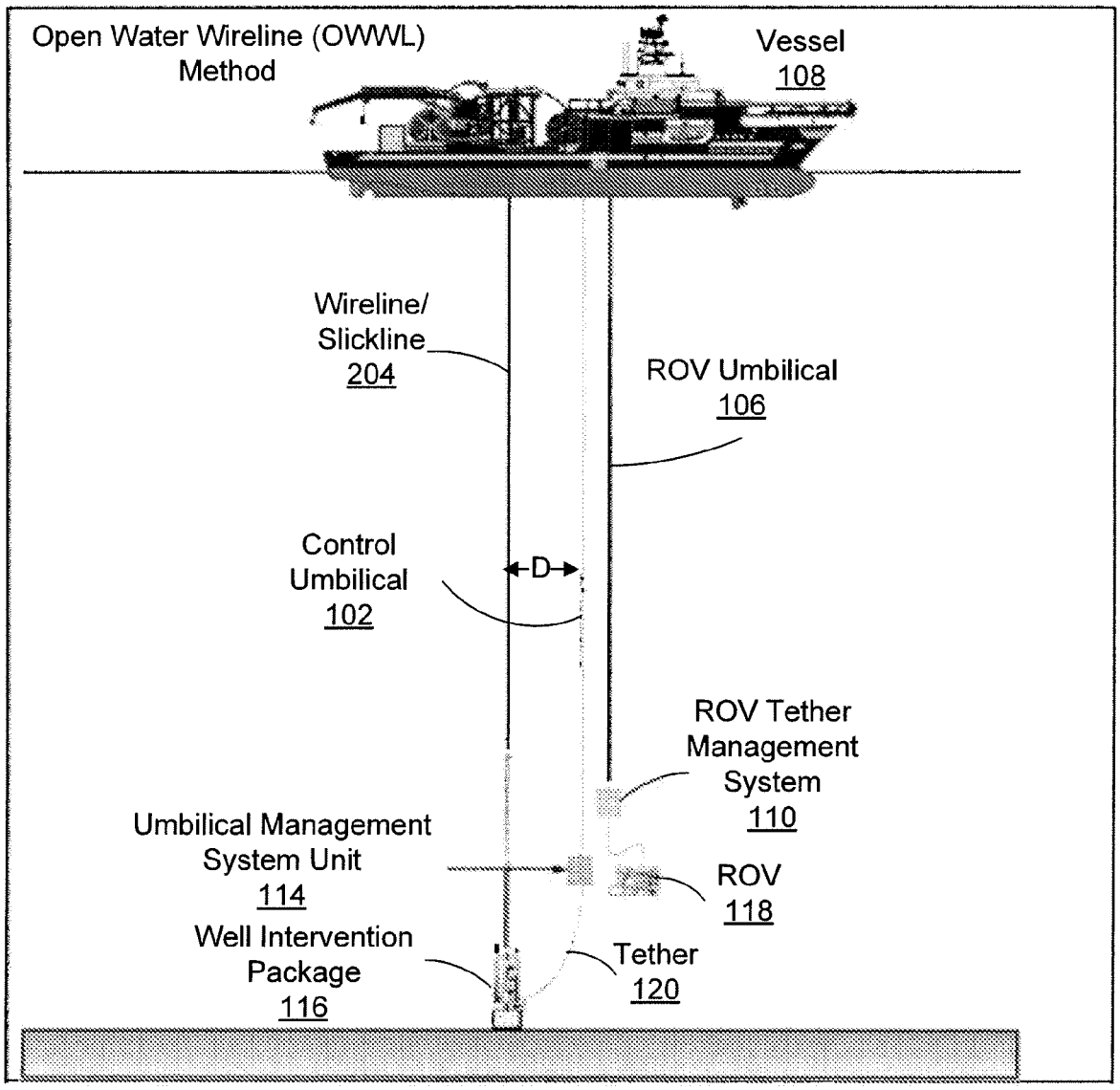
FIG. 2 illustrates an exemplary Open Water Wireline (OWWL) method and system comprising a CU or MCU with a dedicated UMSU and a tether for subsea intervention and work-over on seabed equipment, according to another embodiment of the present invention.

Referring now to the drawings, wherein like reference numerals designate identical or corresponding parts throughout the several views, and more particularly to FIGS. 1-2 thereof, there are illustrated exemplary systems 100 and 200 for subsea intervention, such as light well intervention, and work-over on seabed equipment, including a dedicated Umbilical Management System Unit (UMSU) 114 hanging freely from a vessel 108 and a length of umbilical 120 referred to as a "jumper" or "tether" bridging the gap between the main control umbilical (CU) or multipurpose control umbilical (MCU) 102 termination and the seabed/subsea equipment, such as well intervention package 116, and the like, to be controlled. The length and, to some degree, the shape of the CU or MCU 102 or tether 120 can be actively adjusted from the vessel 108, via means or devices known in the art (not shown) included within the UMSU 114. Whenever we refer to the well intervention package 116, it will be understood that other seabed/subsea equipment can also be used, instead of or in conjunction with the well intervention package.

Figure 3:
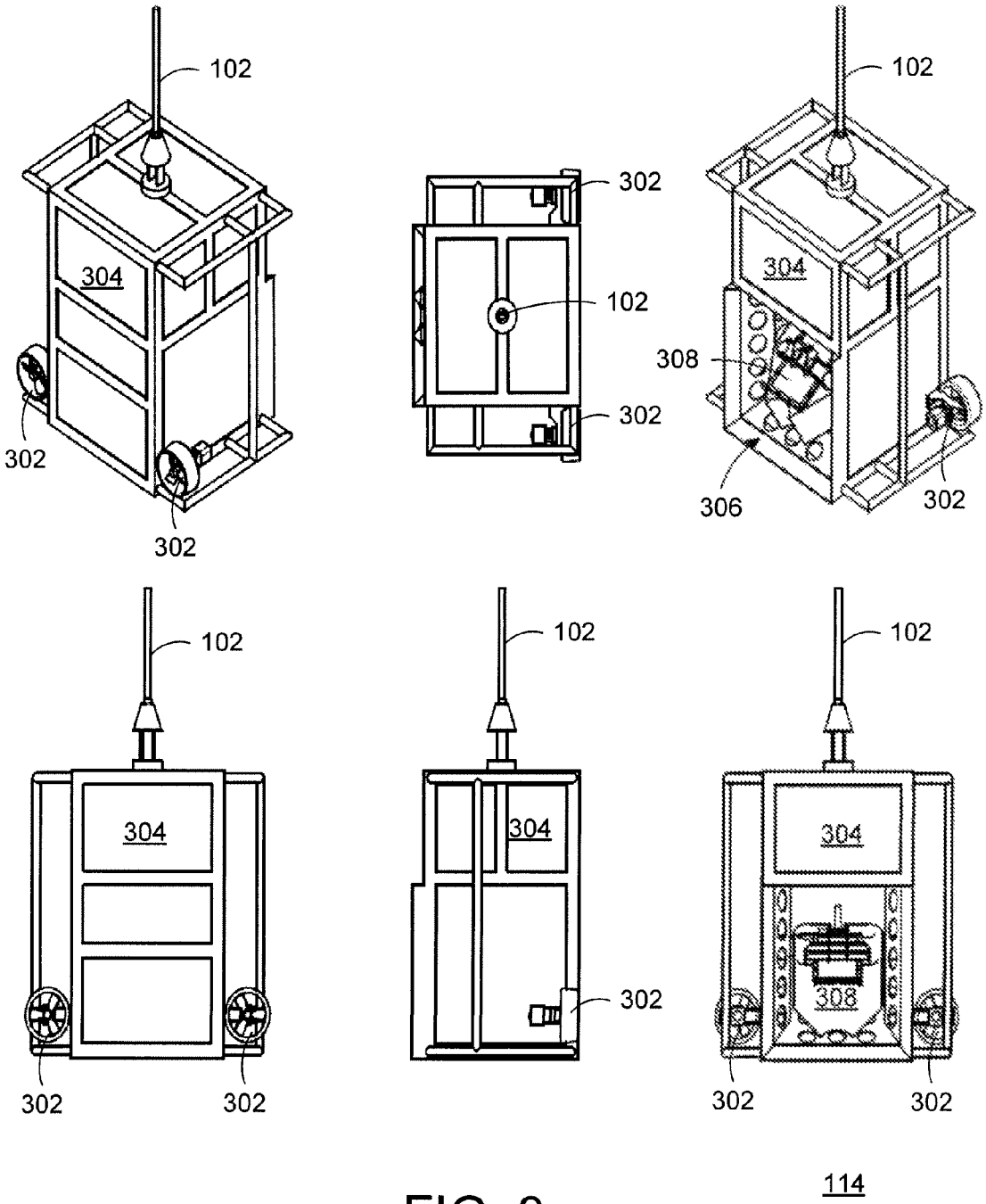
FIG. 3 illustrates the exemplary UMSU of FIGS. 1-2, according to an embodiment of the present invention.
Figure 4:
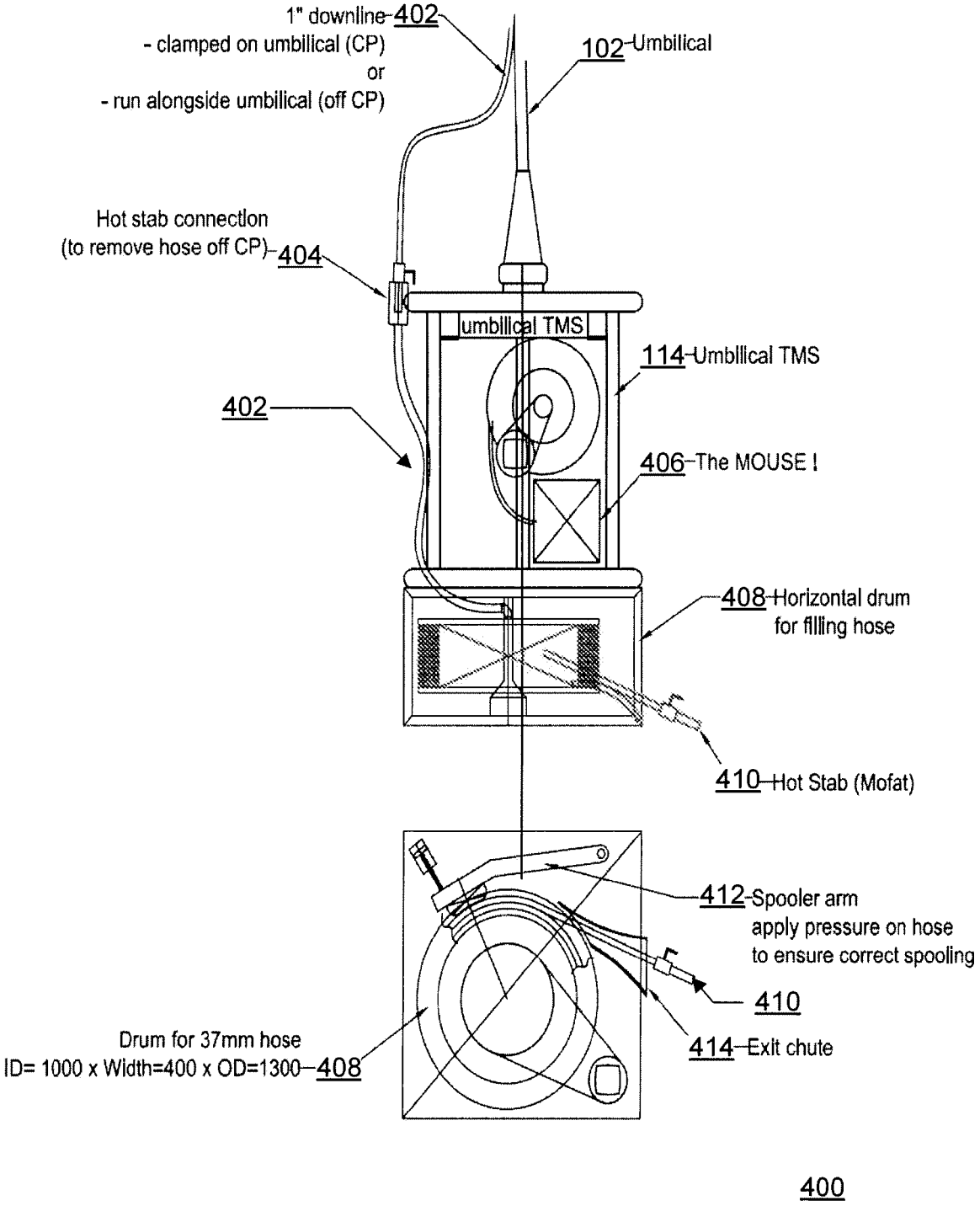
FIG. 4 illustrates an exemplary hose drum system for downline length adjustment used with the systems of FIGS. 1-2, according to an embodiment of the present invention.

In further exemplary embodiments, as shown in FIGS. 3-4, the UMSU 114 of the exemplary systems 100 and 200 can include positioning devices, such as thrusters 302 (e.g., motorized type with propellers, etc.), and the like, allowing the UMSU 114 position to be actively managed from the surface vessel 108 (e.g., to move the UMSU 114 in two planes and rotate about its central axis in the water column). FIG. 3 shows various views of the UMSU 114, wherein the length and shape of the CU or MCU 102, or tether 120 can be adjusted, for example, by a winch 304, and the like, which can reel in or pay out an adjustable length of the CU or MCU 102, or tether 120, with the positioning devices, such as the thrusters 302, and the like, allowing the position of the UMSU 114 to be deployed and/or accurately controlled. Advantageously, the UMSU 114 need not be stationery relative to the seafloor, but rather is free to move, preferably by adjusting the length of the CU or MCU 102, or tether 120 using any suitable tether system that can control the length of the CU or MCU 102, or tether 120 dispensed from the UMSU 114, as needed (e.g., such as tether management systems used on ROVs, and the like).

The UMSU 114 uses a side entry 306 so that the tether 120 can deploy out of the side of the UMSU 114 structure. By contrast, ROV tethers are more commonly deployed from the bottom of a tether management system (TMS). However, when the tether 120 is connected to the well intervention package 116 at tether connection point 308, the side entry 306 of the UMSU 114, advantageously, prevents twists from forming in the tether 120, due to rotation of the UMSU 114, while the UMSU 114 is hanging from the support vessel 108. Twists that are imparted on a tether, and which are common on ROV tether management systems, result in spooling problems and tether failures, and they are advantageously addressed by the exemplary UMSU 114.

In addition, the exemplary UMSU 114 is much lighter than an ROV tether management system, because the UMSU 114 need not account for handling the mass of the ROV in or out of the water. The exemplary UMSU 114 is thus more maneuverable and advantageously employs lower power deployment equipment than the systems used on ROVs. Further, while ROV systems are permanently connected to their vehicles, the UMSU 114 can include any suitable tether connection means that can connect or disconnect subsea to the intervention package 116. The connection can be completed on the deck of the support vessel 108 or subsea by using an ROV, and the like. The tether 120 is stored and deployed from the winch drum and spooling system 304 inside the UMSU 114 and can be operated by any suitable hydraulic and/or electrical supply, and the like. The winch drum and associated drives and sheaves 304 can be driven by any suitable hydraulic and/or electrical means, and the like, configured to pull in and pay out the tether 120, as applicable. In further exemplary embodiments, any suitable constant tension mechanisms can be employed to control the line pull on the tether 120.

Once the tether 120 is connected to the intervention package 116, a constant tension can be applied to the tether 120 from the drive system 304 of the UMSU 114 to keep the tether 120 under a fixed tension, advantageously, preventing the tether 120 from contacting the ocean floor or entangling on the intervention package 116 or related equipment on the ocean floor. The load on the tether 120 can be adjusted by manual means or automatically within the control system of the UMSU 114. The tether 120 can be prevented from breaking by using any suitable tether control function, such as render out control function, and the like, set so that the maximum load on the tether 120 is set at the working limit of the tether 120. The thrusters 302 or the like are installed on the UMSU 114 to actively maintain the CU or MCU 102 away from other cables or equipment deployed subsea to prevent clashing. The UMSU 114 can be remotely controlled from the surface support vessel 108 using any suitable manual or automated positioning controls, and the like.

FIG. 4 illustrates various views of an exemplary hose drum system 400 for use with the exemplary systems of FIGS. 1-2, according to an embodiment of the present invention. In FIG. 4, the exemplary systems of FIGS. 1-2 can include a separate fluid top-up line 402 (also referred to as a "downline") clamped to the CU or MCU umbilical 102 or run alongside the umbilical CU or MCU 102 (off CU or MCU) and a means to deploy the separate fluid top-up line 402 for chemical injection or topping up of other fluids either directly to the system using the line 402 or to subsea tanks, and the like. The fluid line 402, if needed, can also be used to replace lost fluid from the subsea hydraulic system by using the ROV 118 to connect the line 402 via hot stab connection 404 to different parts of the systems and switching fluids at the surface. There are several ways to integrate the top-up line 402 to the UMSU 114, including attaching the line 402 from the surface to the umbilical 102 with a separate horizontal hose drum or reel 408 mounted on the UMSU 114. The reel 408 includes a constant tension capability via spooler arm 412 operated by a power system on the UMSU 114. Another hot stab connection 404 is provided for detaching the line 402 from the UMSU 114 and the reel 408, and an exit chute 414 is provided for the line 402 with another hot stab connection 410. The UMSU 114 also includes a mouse 406.

Figure 5:
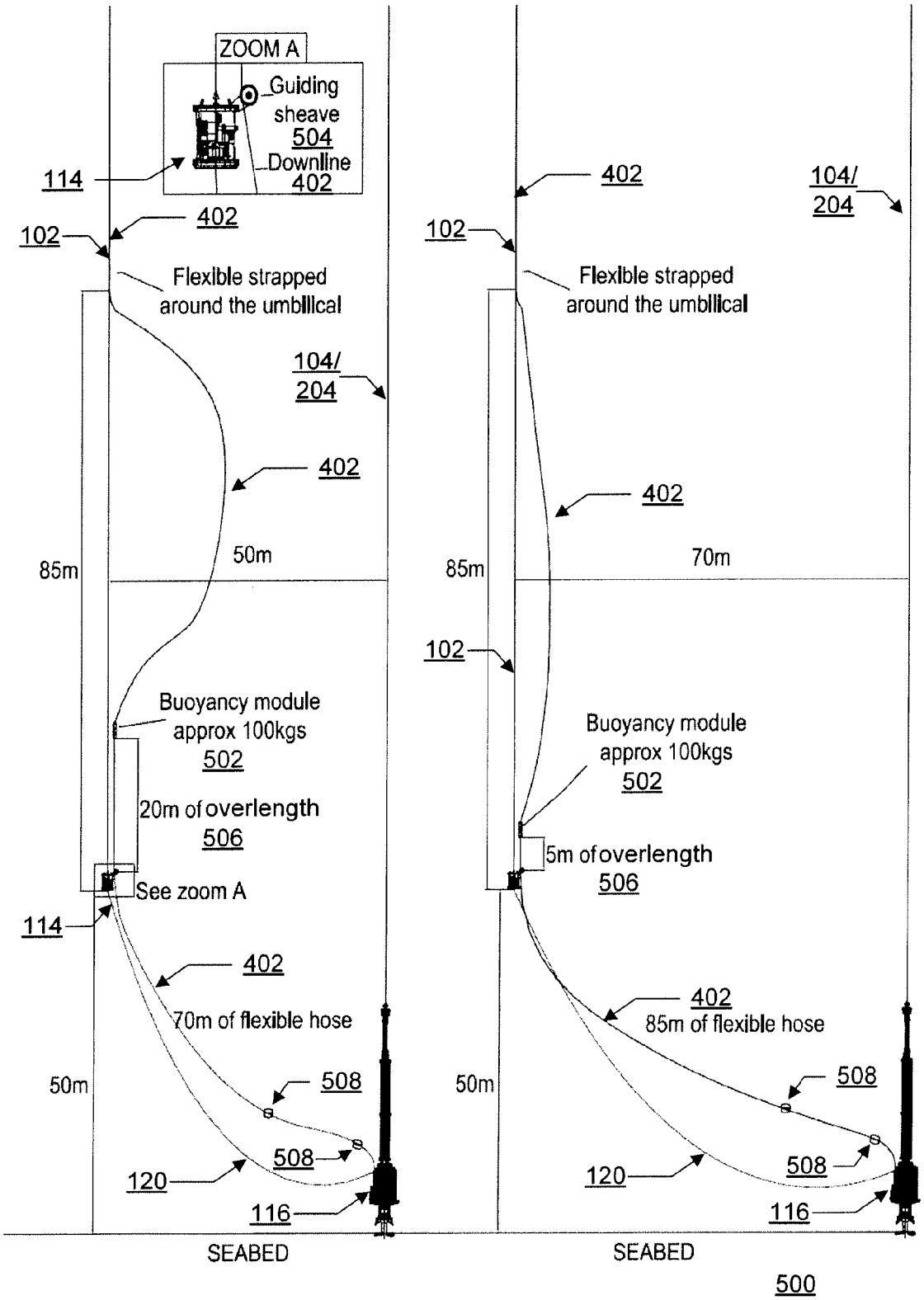
FIG. 5 illustrates an exemplary passive heave compensated system for downline length adjustment for the systems of FIGS. 1-2, according to an embodiment of the present invention.

FIG. 5 illustrates various views of an exemplary passive heave compensated system 500 for downline length adjustment for the systems of FIGS. 1-2. In FIG. 5, another means to deploy the top-up line 402 uses floats 502 and 508 (which may also be referred to herein as "buoyancy modules"), and the like, attached to the respective upper and lower portions of the top-up line 402 and a sheave or roller device 504 mounted on the UMSU 114, wherein the top-up line 402 is slid down using the umbilical 102. The end of the line 402 is attached to the subsea equipment, such as well intervention package 116 by the ROV 118. The upper floats 502 provide tension on a lower section of the line 402 to keep that section under tension. The section of the line 402, between the upper float 502 and the vessel 108, is slackened to accommodate for motion of the vessel 108 with an overlength 506 and is clamped to the CU or MCU 102 at an upper portion thereof, as shown in FIG. 5. Advantageously, the system 500 automatically compensates for the slack in the line 402 without a need for active control from the surface or modification of the UMSU 114.

Turning back to FIGS. 1 and 2, in cases where the Wireline 204 or the Spoolable Compliant Guide 104 is designed to assume a different shape underwater relative to the CU or MCU 102, there may also be an offset distance D advantageously, which can be accommodated or controlled by the UMSU 114. For example, this will almost certainly be the case in specific configurations of the Spoolable Compliant Guide 104, since its design is such that it is deliberately configured to create an offset distance D underwater. Spoolable Compliant Guides are further described in U.S. Pat. Nos. 6,386,290; 6,834,724; 6,691,775; and 6,745,840; in U.S. Patent Application Nos. 20080314597; 20080185153; 20080185152; and PCT application Nos. WO2009053022; WO2008118680; and WO2008122577, all of which are incorporated herein by reference.

In addition, under some conditions, it is possible that the entire support vessel or rig 108 may be permitted to be offset a significant distance away from the center location of the subsea equipment, such as well intervention package 116, advantageously while still maintaining control communications via the UMSU 114. For example, such conditions may be foreseen to be due to the effect of adverse weather and other environmental conditions, such as the prevailing currents, or in cases where emergency conditions arise, such as the temporary loss of station keeping capability of the support vessel or rig 108.

In yet another embodiment of the invention, the offset distance D can also be adjusted with the thrusters 302 on the UMSU 114. The thrusters 302, which can be installed on the UMSU 114, may provide a further means of controlling the shape and position of the CU or MCU 102, while accommodating the heave motion of the vessel 108. In addition, any additional length of slack in CU or MCU 102 or the tether 120 can be stored within the UMSU 114 and can be reeled in or out as needed during operations to provide an adjustable offset distance D of the tether 120. Advantageously, the UMSU 114 also acts as a weight to facilitate heave compensation of the CU or MCU 102 without the need for a cumbersome and expensive "constant tension winch" systems that are used currently.

The UMSU 114 can be configured, for example, as any suitable device that can operate underwater in proximity to the seabed equipment, such as well intervention package 116, and that can reel in or pay out the tether 120 under remote control or autonomously, and the like. The UMSU 114 is preferably capable of communication of data, electrical power and also can provide the connections for transfer of fluids. In one embodiment, two or more separate tethers may be employed preferably in a single overall housing, for data, electrical power communication, hydraulic power and fluids communication as needed.

A further exemplary embodiment includes a well intervention system, such as an Open Water Wireline (OWWL) or Spoolable Compliant Guide (SCG) system, including the CU or MCU 102 further including the tether 120 operatively connected via the UMSU 114, and having communication channels for communicating a plurality of types of media, such as data, electrical power, hydraulic power and chemical treatment fluid, and the like. The UMSU 114 which forms the connection between the CU or MCU 102 and the tether 120 is capable of reeling in or paying out the tether 120 and/or the CU or MCU 102 under remote control or autonomously. The UMSU 114 also has a suitable weight to keep the CU or MCU 102 under tension, as needed, and to compensate for the heave motion experienced with well intervention systems.

The exemplary systems and methods of FIGS. 1-5 can be employed in subsea oil well intervention industry, where the efficiency improvements that they confer in deep water provide a commercial advantage. Thus, the exemplary systems and methods of FIGS. 1-5 have universal application to subsea well intervention, particularly in deep water well intervention, and the like.

The exemplary systems and methods of FIGS. 1-5 are particularly advantageous in deepwater well intervention employing OWWLs or SCGs. For example, the exemplary systems allow deploying, to the seabed, equipment on wire and "guideline-less," or through coiled tubing deployed inside a SCG, advantageously, without a tensioned wire guiding the package to the sea floor. Generally, such deployment may have a tendency to rotate on itself. This rotation may in turn cause the umbilical to become entangled in the running wire if it is deployed with and attached to the package. Further, the vessel 108 may be required to be stationed with a significant offset from the vertical center of the well or subsea equipment, such as well intervention package 116, being worked-over. This offset may have to be adjusted significantly depending on the operations. This requires the umbilical system to be able to cope with such large and varying offsets. Also, in deep waters, the risks of post deployment entanglement of the umbilical with other operational lines and with the compliant guide are increased by the proximity of the various lines and their greater length exposed, unguided and unsupported to the environment.

Thus, the exemplary systems and methods of FIGS. 1-5, employing the CU or MCU 102 with the dedicated UMSU 114 with the powered thrusters 302, overcome the above and other problems with conventional systems and methods. Advantageously, the exemplary systems and methods of FIGS. 1-5 allow for deployment of seabed equipment using OWWL or SCG methods and systems, without a need for constant tension systems for tensioning the deployment means.

The exemplary systems and methods of FIGS. 1-5 allow deployment of the CU or MCU 102 separately from the seabed equipment, such as well intervention package 116, using the dedicated UMSU 114 and tether or tethers 120 to connect to the equipment, such as well intervention package 116, as needed. Advantageously, the CU or MCU 102, the tether 120 and the UMSU 114 are independent of the control umbilical 106 for the ROV 118 and thus high power can be transferred to the subsea equipment, such as well intervention package 116. In addition, the umbilical system, including the CU or MCU 102, the tether 120 and the UMSU 114, advantageously, does not interfere with other deployed downlines, such as wirelines, pumping lines, riser system, ROV umbilicals, and the like, under environmental conditions, and the like.

While the present inventions have been described in connection with a number of exemplary embodiments, and implementations, the present inventions are not so limited, but rather cover various modifications, and equivalent arrangements, which fall within the purview of the appended claims.

What is claimed is:

1. An intervention system deployable from a support vessel or rig for control of seabed equipment, the system comprising:

a control umbilical connectable to the support vessel or rig;

a tether connectable to the seabed equipment; and an umbilical management system unit coupled between the tether and the control umbilical, the umbilical management system unit designed to couple the control umbilical via the tether to the underwater seabed equipment so as to couple the support vessel or rig to the underwater seabed equipment; and wherein the control umbilical and the tether via the umbilical management system unit provide a communications channel for communicating data and power from the support vessel or rig to the seabed equipment for controlling the seabed equipment; and wherein the umbilical management system unit, the control umbilical, and the tether are configured to control a distance between the umbilical management system unit and the underwater seabed equipment.

2. The system of claim 1, wherein the intervention system is a subsea well intervention system comprising an Open Water Wireline system or a Spoolable Compliant Guide system.

3. The system of claim 1, wherein the umbilical management system unit is further configured to act as a weight to keep the control umbilical under tension and compensate for heave motion of the support vessel or rig.

4. The system of claim 1, wherein the system is configured for deep water subsea intervention on the seabed equipment.

5. The system of claim 1, wherein the umbilical management system unit is further configured to control its position, with relation to other subsea equipment, via a motorized device and via means for adjusting a length of the tether and under remote control or autonomously.

6. The system of claim 1, comprising a plurality of tethers linking the umbilical management system unit to one or more seabed equipment.

7. The system of claim 1, wherein the tether is connected to the seabed equipment.

8. The system of claim 1, wherein the control umbilical, the tether, and the umbilical management system unit are independent of a remotely operated vehicle (ROV) control umbilical.

9. The system of claim 1, wherein the system is configured to actively or passively control at least one of the control umbilical, the tether, and the umbilical management system unit in a water column.

10. The system of claim 9, wherein the system is configured to control a length of the tether.

11. The system of claim 10, wherein the umbilical management system unit is configured to control the length of the tether using a winch provided in the umbilical management system unit.

12. The system of claim 10, wherein the umbilical management system unit is configured to control the length of the tether by feeding the tether out through the side and not the bottom of the umbilical management system unit.

13. The system of claim 9, wherein the system is configured to adjust a horizontal position of the umbilical management system unit using one or more thrusters provided in the umbilical management system unit.

14. The system of claim 9, wherein the system is configured to adjust a vertical position of the umbilical management system unit using a winch provided in at least one of the umbilical management system unit and the support vessel or rig.

15. The system of claim 1, further comprising a hose drum or reel provided on the umbilical management system unit for reeling in or paying out a fluid top-up line connected to the control umbilical for chemical injection or topping up of fluids.

16. The system of claim 15, wherein the hose drum or reel includes a constant tension capability provided by a spooler arm, and the hose drum or reel and the spooler arm are operated by a power system of the umbilical management system unit.

17. The system of claim 15, wherein a hot stab connection is provided for detaching the fluid top-up line from the hose drum or reel of the umbilical management system unit, and an exit chute is provided on the hose drum or reel for the fluid top-up line, with the fluid top-up line having another hot stab connection on the exit chute end.

18. The system of claim 1, further comprising a fluid top-up line connected to the control umbilical for chemical injection or topping up of fluids, with upper and lower floats provided on the fluid top-up line for providing tension and/or heave compensation, and with a sheave or roller device mounted on the umbilical management system unit for accommodating the fluid top-up line.

19. The system of claim 1, further comprising:

a fluid line connectable with the control umbilical between the support vessel or rig and the seabed equipment for communicating at least one of hydraulic power and chemical treatment fluid from the support vessel or rig to the seabed equipment.

20. The system of claim 1, wherein the control umbilical and the tether via the umbilical management system unit provide the communications channel for communicating electrical power from the support vessel or rig to the seabed equipment for controlling the seabed equipment.

21. An intervention method for control of seabed equipment from a support vessel or rig, the method comprising:

connecting a control umbilical to the support vessel or rig;

connecting a tether to seabed equipment located underwater;

coupling an umbilical management system unit between the tether and the control umbilical;

coupling with the umbilical management system unit the control umbilical via the tether to the underwater seabed equipment, thereby coupling the support vessel or rig to the seabed equipment;

providing via the control umbilical, the tether, and the umbilical management system unit a communications channel for communicating data and power from the support vessel or rig to the seabed equipment;

controlling a distance between the umbilical management system unit and the seabed equipment with the underwater seabed equipment through the control umbilical and the tether; and controlling the seabed equipment from the support vessel or rig via communications through the control umbilical and the tether.

22. The method of claim 21, wherein the intervention system is a subsea well intervention system comprising an Open Water Wireline system or a Spoolable Compliant Guide system.

23. The method of claim 21, wherein the umbilical management system unit is further configured to act as a weight to keep the control umbilical under tension and compensate for heave motion of the support vessel or rig.

24. The method of claim 21, wherein the method is employed for deep water subsea intervention on the seabed equipment.

25. The method of claim 21, wherein the umbilical management system unit is further configured to control its position, with relation to other subsea equipment, via a motorized device and via means for adjusting a length of the tether and under remote control or autonomously.

26. The method of claim 21, comprising a plurality of tethers linking the umbilical management system unit to one or more seabed equipment.

27. The method of claim 21, wherein the tether is connected to the seabed equipment.

28. The method of claim 21, wherein the control umbilical, the tether, and the umbilical management system unit are independent of a remotely operated vehicle (ROV) control umbilical.

29. The method of claim 21, further comprising actively or passively controlling the control umbilical, the tether, or the umbilical management system unit in a water column.

30. The method of claim 21, further comprising controlling a length of the tether.

31. The method of claim 30, wherein the umbilical management system unit controls the length of the tether using a winch provided in the umbilical management system unit.

32. The method of claim 30, wherein the umbilical management system unit controls the length of the tether by feeding the tether out through the side of the umbilical management system unit.

33. The method of claim 29, further comprising adjusting a horizontal position of the umbilical management system unit using one or more thrusters provided in the umbilical management system unit.

34. The method of claim 29, further comprising adjusting a vertical position of the umbilical management system unit using a winch provided in the umbilical management system unit or the support vessel or rig.

35. The method of claim 21, further comprising reeling in or paying out a fluid top-up line connected to the control umbilical for chemical injection or topping up of fluids with a hose drum or reel provided on the umbilical management system unit.

36. The method of claim 35, wherein the hose drum or reel includes a constant tension capability provided by a spooler arm, and the hose drum or reel and the spooler arm are operated by a power system of the umbilical management system unit.

37. The method of claim 35, wherein a hot stab connection is provided for detaching the fluid top-up line from the hose drum or reel of the umbilical management system unit, and an exit chute is provided on the hose drum or reel for the fluid top-up line, with the fluid top-up line having another hot stab connection on the exit chute end.

38. The method of claim 21, further comprising chemical injection or topping up of fluids with a fluid top-up line connected to the control umbilical, providing tension and/or heave compensation with upper and lower floats provided on the fluid top-up line, and accommodating the fluid top-up line with a sheave or roller device mounted on the umbilical management system unit.

39. The method of claim 21, further comprising:

connecting a fluid line to the control umbilical and between the support vessel or rig and the seabed equipment; and communicating at least one of hydraulic power and chemical treatment fluid from the support vessel or rig to the seabed equipment through the fluid line.

40. The method of claim 21, wherein the control umbilical, the tether, and the umbilical management system unit provide the communications channel for communicating electrical power from the support vessel or rig to the seabed equipment.

* * * * *